US008904779B2

(12) United States Patent
Katayama et al.

(10) Patent No.: US 8,904,779 B2
(45) Date of Patent: Dec. 9, 2014

(54) STIRLING ENGINE GAS LUBRICATION STRUCTURE

(75) Inventors: Masaaki Katayama, Susono (JP); Daisaku Sawada, Gotenba (JP); Hiroshi Yaguchi, Susono (JP); Manabu Tateno, Shizuoka-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 99 days.

(21) Appl. No.: 13/697,855

(22) PCT Filed: Jun. 1, 2010

(86) PCT No.: PCT/JP2010/059282

§ 371 (c)(1),
(2), (4) Date: Nov. 14, 2012

(87) PCT Pub. No.: WO2011/151896

PCT Pub. Date: Dec. 8, 2011

(65) Prior Publication Data

US 2013/0061826 A1 Mar. 14, 2013

(51) Int. Cl.

| | |
|---|---|
| ***F01B 29/10*** | (2006.01) |
| ***F02G 1/043*** | (2006.01) |
| ***F02G 1/053*** | (2006.01) |

(52) U.S. Cl.

CPC ..... *F02G 1/043* (2013.01); *F02G 2243/32* (2013.01); *F02G 2253/60* (2013.01); *F02G 1/053* (2013.01)

USPC ..... 60/517; 60/518; 60/519

(58) Field of Classification Search

USPC ..... 60/516, 517, 525

See application file for complete search history.

(56) References Cited

U.S. PATENT DOCUMENTS

| | | | | |
|---|---|---|---|---|
| 2004/0025489 | A1 * | 2/2004 | Conde et al. | 60/39.6 |
| 2005/0274111 | A1 | 12/2005 | Yaguchi et al. | |
| 2008/0072751 | A1 * | 3/2008 | Sawada et al. | 92/172 |
| 2009/0094980 | A1 * | 4/2009 | Sawada et al. | 60/615 |
| 2010/0199944 | A1 | 8/2010 | Katayama et al. | |

FOREIGN PATENT DOCUMENTS

| | | |
|---|---|---|
| JP | 61-207862 | 9/1986 |
| JP | 2005-76557 | 3/2005 |
| JP | 2005-351243 | 12/2005 |
| JP | 2007-270662 | 10/2007 |
| JP | 2007270662 A * | 10/2007 |
| JP | 2008-128190 | 6/2008 |
| JP | 2009-47022 | 3/2009 |
| JP | 2009-52479 | 3/2009 |

* cited by examiner

*Primary Examiner* — Noah Kamen
*Assistant Examiner* — Tea Holbrook
(74) *Attorney, Agent, or Firm* — Finnegan, Henderson, Farabow, Garrett & Dunner, LLP

(57) ABSTRACT

In a case of performing a static pressure gas lubrication by a stirling engine provided with a pair of cylinders of a high-temperature-side cylinder 20 and a low-temperature-side cylinder 30, a stirling engine gas lubrication structure is provided with an introduction pipe 70A for introducing a working fluid existing within a low-temperature working space into at least an inside of an expansion piston 21 of the expansion piston 21 and a compression piston 31, the low-temperature working space being included in a working space where the working fluid circulates between the cylinders 20 and 30, a temperature of the working fluid in the low-temperature working space lower than that of the working fluid in a working space of a high-temperature side cylinder 22 in a driving state.

5 Claims, 10 Drawing Sheets

STIRLING ENGINE GAS LUBRICATION STRUCTURE

CROSS-REFERENCE TO RELATED APPLICATIONS

This application is a national phase application of International Application No. PCT/JP2010/059282, filed Jun. 1, 2010, the content of which is incorporated herein by reference.

TECHNICAL FIELD

The present invention relates to a stirling engine gas lubrication structure.

BACKGROUND ART

Recently, stirling engines have been increasingly focused on, and its purpose is to recover exhaust heat of internal combustions provided in vehicles such as automobiles, buses, or trucks, or exhaust heat of factories. High thermal efficiency of the stirling engine is expected. Further, the stirling engine can use low-temperature difference alternative energies such as solar heat, geothermal heat, or exhaust heat, because the stirling engine is an external combustion which heats the working fluid from its outside. The stirling engine has an advantage of saving energy.

Patent Documents 1 to 6, considered relative to structures of the present invention, disclose techniques of the stirling engines.

PRIOR ART DOCUMENT

Patent Document

[Patent Document 1] Japanese Patent Application Publication No. 2009-47022
[Patent Document 2] Japanese Patent Application Publication No. 61-207862
[Patent Document 3] Japanese Patent Application Publication No. 2005-76557
[Patent Document 4] Japanese Patent Application Publication No. 2008-128190
[Patent Document 5] Japanese Patent Application Publication No. 2007-270662
[Patent Document 6] Japanese Patent Application Publication No. 2005-351243

SUMMARY OF THE INVENTION

Problems to be Solved by the Invention

Patent Document 1 discloses a technique of a so-called autonomous static pressure gas lubrication in which static pressure gas lubrication for a piston is performed by a working fluid introduced from a working space. The technique disclosed in Patent Document 1 has an advantage in cost, because a pressure pump for supplying the pressurized working fluid into the piston for the static pressure gas lubrication. However, when the working fluid is introduced into the piston from the working space, the working fluid receiving heat from a heater is introduced into the working space of a high-temperature-side cylinder. Thus, the working fluid has an excessively high temperature. In the technique disclosed in Patent Document 1, for example, the introduced working fluid promotes the heat deformation of the piston. As a result, this might influence the gas lubrication.

Also, as for the working fluid introduced into the piston from the working space of the high-temperature-side cylinder, its temperature in ejecting the working fluid is lower than that in introducing the working fluid. In this case, the capacity of the working fluid at the time of being ejected is smaller than that at the time of being introduced. As a result, it might be difficult to ensure an amount of the working fluid for performing the gas lubrication.

Therefore, the present invention has been made in view of the above circumstances and has an object to provide a stirling engine gas lubrication structure suitably achieving a autonomous static pressure gas lubrication.

Means for Solving the Problems

In order to overcome the above problem, an aspect of the present invention is a stirling engine gas lubrication structure including a pair of cylinders including: a high-temperature-side cylinder including a high-temperature side cylinder and a high-temperature side piston reciprocating within the high-temperature side cylinder; and a low-temperature-side cylinder including a low-temperature side cylinder and a low-temperature side piston reciprocating within the low-temperature side cylinder, at least the high-temperature side piston, of the high-temperature side piston and the low-temperature side piston, including: a hollow portion; and an air supply portion ejecting a working fluid toward a clearance between the hollow portion and a cylinder, of the high-temperature cylinder and the low-temperature cylinder, corresponding to the hollow portion, further including a flow structure, for the working fluid, introducing a working fluid existing within a low-temperature working space into at least an inside of the high-temperature side cylinder of the high-temperature side cylinder and the low-temperature side cylinder, the low-temperature working space being included in a working space where the working fluid circulates between the high-temperature-side cylinder and the low-temperature-side cylinder, a temperature of the working fluid in the low-temperature working space lower than that of the working fluid in a working space of the high-temperature side cylinder in a driving state.

Also, an aspect of the present invention is a stirling engine gas lubrication structure including a pair of cylinders including: a high-temperature-side side cylinder including a high-temperature side cylinder and a high-temperature side piston reciprocating within the high-temperature side cylinder; and a low-temperature-side cylinder including a low-temperature side cylinder and a low-temperature side piston reciprocating within the low-temperature side cylinder, at least the high-temperature side piston, of the high-temperature side piston and the low-temperature side piston, including; a hollow portion; and an air supply portion ejecting a working fluid toward a clearance between the hollow portion and a cylinder, of the high-temperature cylinder and the low-temperature cylinder, corresponding to the hollow portion, further including a flow structure, for the working fluid, communicating a low-temperature working space with the hollow portion of the high-temperature side piston, the low-temperature working space being included in a working space where the working fluid circulates between the high-temperature-side cylinder and the low-temperature-side cylinder, a temperature of the working fluid in the low-temperature working space lower than that of the working fluid in a working space of the high-temperature side cylinder in a driving state.

Preferably, in the present invention, the stirling engine may be a multiple cylinder stirling engine including at least four cylinders that are plural pairs of cylinders, and the flow structure may communicate the low-temperature working space, having a temperature being the lowest in the low-temperature working spaces of the plural pairs of the cylinders, with the hollow portions of the high-temperature side pistons of the plural pairs of the cylinders.

Preferably, in the present invention, the stirling engine may include an approximate linear linkage causing a corresponding piston of the high-temperature side piston and the low-temperature side piston of the pair of the cylinders to reciprocate linearly, the flow structure may be provided along the approximate linear linkage corresponding to a piston, of the high-temperature side piston and the low-temperature side piston, including the hollow portion connected to the flow structure, a part of the flow structure may be provided along the corresponding approximate linear linkage, and the part is a movable portion including: a joint portion capable of rotating in response to a movement of the corresponding approximate linear linkage; and pipe portions connected to each other through the joint portion, and a rotational center of the joint portion may be identical to a fulcrum of the corresponding approximate linear linkage.

Preferably, the present invention may be further comprise a communication portion communicating an inner space of a crank case provided in the stirling engine with a working space where the working fluid circulates between the high-temperature side cylinder and the low-temperature side cylinder in the pair of the cylinders defining the low-temperature working space communicating with the flow structure.

Effects of the Invention

According to the present invention, a autonomous static pressure gas lubrication can be suitably achieved.

MODES FOR CARRYING OUT THE INVENTION

In the following, embodiments according to the present invention will be described in detail with reference to drawings.

First Embodiment

Figure 1:
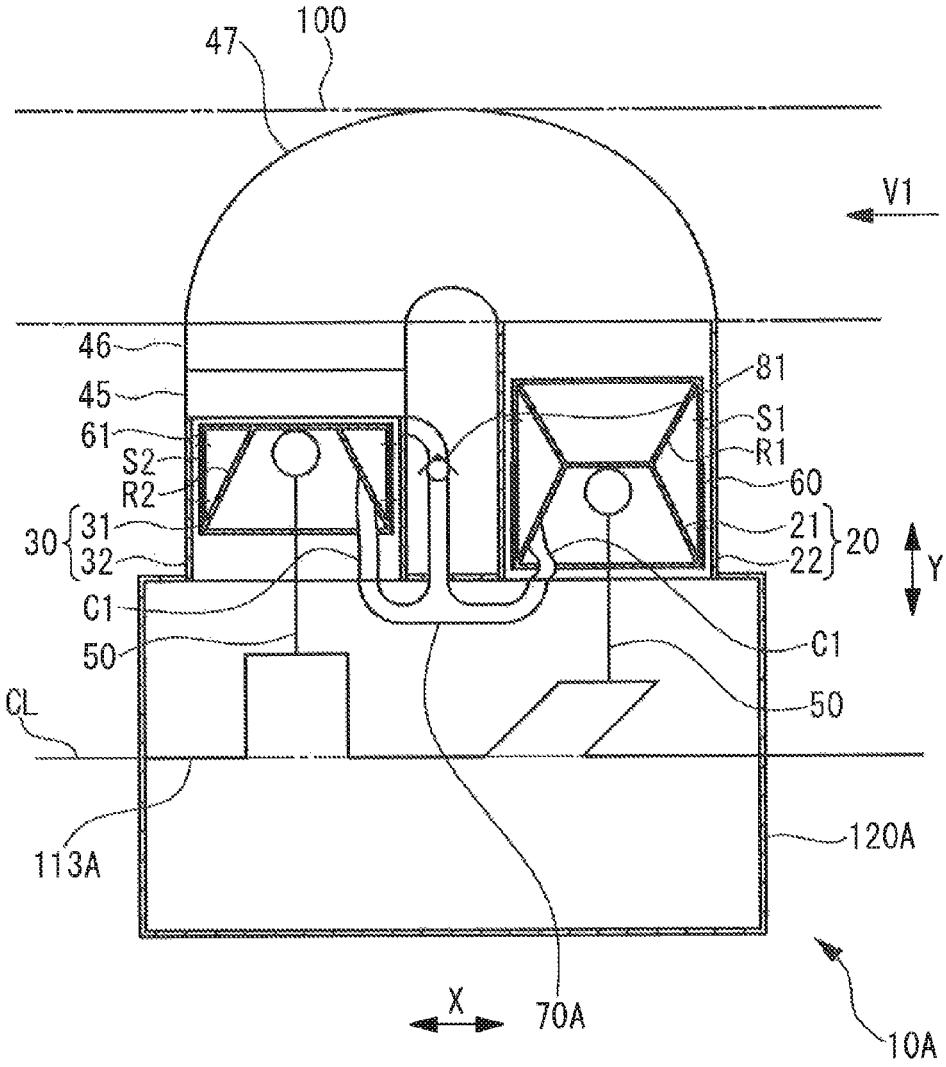
FIG. 1 is a schematic view of a stirling engine provided with a stirling engine gas lubrication structure according to a first embodiment.

FIG. 1 is a schematic view of a stirling engine 10A provided with a stirling engine gas lubrication structure according to a first embodiment. The stirling engine 10A is a twin cylinder a type including a high-temperature-side cylinder 20 and a low-temperature-side cylinder 30 as a pair of cylinders. The cylinders 20 and 30 are linearly and parallel arranged with each other such that the extension direction of a crank shaft axis CL is parallel with the direction X where the cylinders are arranged. The high-temperature-side cylinder 20 includes an expansion piston 21 and a high-temperature side cylinder 22, and the low-temperature-side cylinder 30 includes a compression piston 31 and a low-temperature side cylinder 32. There is a phase difference between the compression piston 31 reciprocating within the low-temperature side cylinder 32 and the expansion piston reciprocating within the high-temperature side cylinder 22 such that the compression piston 31 delays in movement relative to the expansion piston by about 90 degrees of a crank angle.

A space at the upper side of the high-temperature side cylinder 22 is an expansion space. A working fluid heated by a heater 47 flows into the expansion space. In the present embodiment, specifically, the heater 47 is arranged within an exhaust pipe 100 of a gasoline engine provided in a vehicle. In this regard, the stirling engine 10A is arranged such that the extending direction of the crank shaft axis CL (in the other words, the direction X where the cylinders are arranged) is parallel with the flowing direction V1 of exhaust gas. In the heater 47, the working fluid is heated by thermal energy recovered from the exhaust gas which is a fluid as a high temperature heat source.

A space at the upper side of the low-temperature side cylinder 32 is a compression space. The working fluid cooed by a cooler 45 flows into the compression space.

A regenerator 46 transmits and receives the heat to and from the working fluid reciprocating between the expansion and compression spaces. Specifically, the regenerator 46 receives the heat from the working fluid when the working fluid flows from the expansion space to the compression space. The regenerator 46 transmits the storage heat to the working fluid when the working fluid flows from the compression space to the expansion space.

Air is employed as the working fluid. However, the working fluid is not limited to air. For example, gas such as He, H2, or N2 is applicable to the working fluid.

Next, the operation of the stirling engine 10A will be described. The working fluid is heated by the heater 47 to expand, so the expansion piston 21 is pressure-moved downwardly and a crank shaft 113A rotates. Next, when the expansion piston 21 is in a process of moving upwardly, the working fluid is transmitted to the regenerator 46 through the heater 47. The working fluid dissipates heat in the regenerator 46 and flows into the cooler 45. The working fluid cooled in the cooler 45 flows into the compression space, and is compressed by the process of upper movement of the compression piston 31. The working fluid, compressed by this way, deprives heat from the regenerator 46 to increase its temperature. The working fluid flows into the heater 47 to be heated and expanded therein. That is, the stirling engine 10A is operated by the reciprocation of the working fluid.

Incidentally, the heat source is exhaust gas of the internal combustion of the vehicle in the present embodiment. For this reason, there is a restriction in the obtainable amount of heat and the stirling engine 10A has to be operated based on the obtainable amount of heat. Thus, the internal friction within the stirling engine 10A is reduced as much as possible in the present embodiment. Specifically, to eliminate the largest frictional loss of a piston ring in the internal friction within the stirling engine 10A, the gas lubrication is performed between the high-temperature side cylinder 22 and the piston 21, and between the cylinder 32 and the piston 31.

In the gas lubrication, the pistons 21 and 31 are floated in the air by utilizing the air pressure (distribution) generated between the minute clearances between the high-temperature side cylinder 22 and the piston 21 and between the cylinder 32 and the piston 31. The sliding resistance of the gas lubrication where an object is floated in the air is extremely small, thereby greatly reduce the internal friction within the stirling engine 10A.

The gas lubrication is performed in each of the clearances between the high-temperature side cylinder 22 and the piston 21 and between the cylinder 32 and the piston 31, and each clearance is about several tens of micrometers. The working fluid of the stirling engine 1.0A is present in the clearances. The pistons 21 and 31 are supported not to contact with the cylinders 22 and 32, or are supported to be allowable contact with the cylinders 22 and 32, respectively. Thus, there is no provision of piston rings in the periphery of the pistons 21 and 31. Further, there is no use of lubrication oil which is generally used together with the piston ring. In the gas lubrication, the minute clearance makes each of the expansion and compression spaces to be airproofed, and the clearance is sealed without a ring or oil.

Further, the pistons 21 and 31 and the cylinders 22 and 32 are made of metals. In the present embodiment, specifically, the piston 21 and the cylinder 22 are made of the same metals (herein SUS) having the same linear expansion coefficient, and the piston 31 and the cylinder 32 are made of the same metals (herein SUS) having the same linear expansion coefficient. Thus, even when heat is expanded, the clearance can be suitably maintained to perform the gas lubrication.

Incidentally, the gas lubrication has a small load capability. Therefore, side forces against the pistons 21 and 31 have to be substantial zero. That is, in the case of the gas lubrication, each of the pistons 21 and 31 has a low capability (a pressure-resistant capability) to resist a force in the diameter direction (lateral direction, or thrust direction) of the cylinders 22 and 32. Thus, high accuracy is needed in liner movements of the pistons 21 and 31 with respect to axis lines of the cylinders 22 and 32, respectively.

For this reason, the present embodiment employs grasshopper mechanisms 50 arranged between the piston and the dank portion. The mechanism for achieving a liner movement includes a watt mechanism, for example, in addition to the grasshopper mechanism 50. The grasshopper mechanism 50 has a small size, for requesting the same accuracy in liner motions, than that of another mechanism. Thus, the entire size of the device is reduced. Particularly, the stirling engine 10A according to the present embodiment is arranged in a limited space under the floor of the automobile. Thus, a more flexible design is allowed as the device size is reduced. The grasshopper mechanism 50 is lighter, for requesting the same accuracy in liner motions, than that of another approximate-line mechanism. Thus, the grasshopper mechanism 50 has an advantage of mileage. Further, the grasshopper mechanism 50 has an advantage of being configured (produced, or assembled) with ease, because the configuration of the grasshopper mechanism 50 is comparatively simple.

Figure 2:
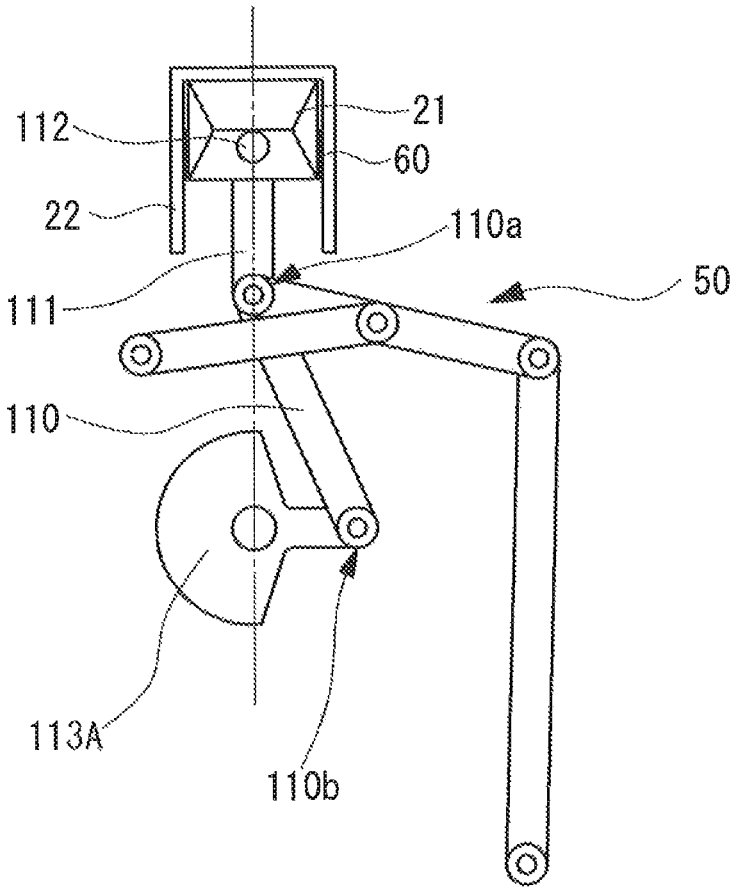
FIG. 2 is a schematic view of piston and crank portions.

FIG. 2 is a schematic view of a general configuration of a piston crank portion of the stirling engine 10A. Additionally, common components are employed in the piston and crank portions of the high-temperature-side cylinder 20 and the low-temperature-side cylinder 30A. Thus, hereinafter, only the high-temperature-side cylinder 20 will be explained and the explanation of the low-temperature-side cylinder 30 is omitted, in approximate linear linkage includes a grasshopper mechanism 50, a connecting rod 110, an extension rod 111, and a piston pin 112. The expansion piston 21 is connected to the crank shaft 113A through the connecting rod 110, the extension rod 111 and the piston pin 112. Specifically, the expansion piston 21 is connected to a end of the extension rod 111 through the piston pin 112. The other end of the extension rod 111 is connected to a small end 110*a* of the connecting rod 110. The large end 110*b* of the connecting rod 110 is connected to the crank shaft 113A. Additionally, the approximate linear linkage may have another linkage between the extension rod 111 and the piston pin 112.

The reciprocation movement of the expansion piston 21 is transmitted to the crank shaft 113A provided in the crank case 120A by the connecting rod 110, and then is converted into a rotational movement. The connecting rod 110 is supported by the grasshopper mechanism 50, and reciprocates the expansion piston 21 linearly. Accordingly, the connecting rod 110 is supported by the grasshopper mechanisms 50, so the side force F against the expansion piston 21A is substantial zero. Therefore, the expansion piston 21A can be suitably supported, even when the gas lubrication with a small load capability is performed.

Incidentally, there might be present the foreign matter such as a minute metallic piece, which cannot be removed at the production time, within a heat exchanger such as the cooler 45, the regenerator 46, or the heater 47. Further, the minute metallic piece might be dropped off, as the foreign matter, from the regenerator 46 including a metallic mesh during the engine operation. During the operation of the stirling engine 10A, the foreign matter might enter the expansion and compression spaces, and might further enter the clearances between the piston 21A and the cylinder 22 and between the piston 31 and the cylinder 32. Thus, the foreign matter might grow to become adhesive. The temperature of the stirling engine 10A becomes high, so it is necessary to consider the influence of the heat expansion and the temperature, and it is difficult to control the clearance. To deal with the adhesion under the high-temperature circumstances, the expansion piston 21 is provided with a layer 60 at its outer circumferential surface.

The layer 60 is configured to coat a resin. The resin has a linear expansion coefficient larger than one of the base material of the expansion piston 21, and has flexibility. In the present embodiment, specifically, the resin is a fluorinated resin. Generally, the liner expansion coefficient of the resin is from about 4 to about 10 times higher than that of a metal. It is difficult to employ the resin in the outer surface of the expansion piston 21 having the radial clearance being about several tens of micrometers. The liner expansion coefficient of the layer 60 is set such that the clearance between the high-temperature side cylinder 22 and the layer 60 is made smaller as the temperature increases.

The thickness of the layer 60 under the ambient temperature is equal to or more than the radial clearance. That is, in the present embodiment, the thickness of the layer 60 is equal to or double of the radial clearance. The resin is coated at many times, whereby the thickness of the layer 60 is achieved. The thickness of the layer 60 under the ambient temperature is one such that the clearance between the layer 60 and the high-temperature side cylinder 22 is ensured, even when the heat expansion is generated under use conditions. In this regard, the temperature of the working fluid is changeable from ambient temperature to several hundred Celsius degrees. For example, the lowest usual temperature of the working fluid is minus 40 Celsius degrees, and the maximum used temperature is 400 Celsius degrees.

The expansion piston 21 and the high-temperature side cylinder 22 are made of the metals (herein, SUS) having the same linear expansion coefficient. For this reason, the radial clearance between the metal portions is not actually changed before or after heat expansion. On the other hand, the thickness of the layer 60, which has the linear expansion coefficient larger than that of the metal, becomes larger after heat expansion, thereby making the radial clearance smaller after heat expansion.

On the other hand, a size of a foreign matter which is allowed to enter the radial clearance is basically smaller than the radial clearance under the ambient temperature, and is exceptionally double as large as the radial clearance at a maximum.

Even if the foreign matter enters the clearance between the expansion piston 21 (accurately, the layer 60) and the high-temperature side cylinder 22, such an entered matter is attached to the layer 60 by the flexibility thereof and is caught at the time of for example, the heat expansion. After that, when the expansion piston 21 (accurately, the layer 60) comes close to the high-temperature side cylinder 22 or comes into contact with the high-temperature side cylinder 22 during the engine operation in a subsequent process, the matter may be buried in the layer 60 having the flexibility. This prevents an increase in the surface pressure caused by the foreign matter, and prevents the adhesion.

Further, even if the entered foreign matters are combined with each other and become larger, the foreign matters can be allowed to enter and grow, until the size of the foreign matters becomes a size determined by adding the radial clearance to the thickness of the layer 60.

Moreover, since the layer 60 is made of the fluorinated resin having a function of solid lubricant, the adhesion caused by the layer 60 itself can be prevented.

Additionally, in the stirling engine 10A, the compression piston 31 is provided with a layer 61 in which foreign matters can be buried. In this regard, the thickness of the layer 61 is set depending on the use condition of the low-temperature-side cylinder 30, as compared with the layer 60. Also, the layer 60 is provided in a predetermined range from the lower end to the upper end of the expansion piston 21 in order to avoid the heat influence by the working fluid existing in the heater 47 or the working space of the high-temperature side cylinder 22. In contrast, the layer 61 can be provided in a whole range from the upper end to the lower end of the compression piston 31.

Incidentally, as for the gas lubrication, the stirling engine 10A performs the static pressure gas lubrication in which a pressurized fluid is ejected to generate a static pressure for floating the object.

In this regard, accumulator chambers R1 and R2 are respectively provided in the expansion piston 21 and the compression piston 31. The accumulator chambers R1 and R2 are respectively provided along the side wall portions of the pistons 21 and 31, and each define a ring-shaped space around the circumference. The accumulator chambers R1 and R2 respectively corresponds to hollow portions.

Also, air supply holes S1 and S2 are respectively provided in the expansion piston 21 and the compression piston 31. The air supply holes S1 and S2 are respectively provided at the side wall portions of the pistons 21 and 31. Also, each of plural air supply holes S1 and plural air supply holes S2 are provided at even intervals. The air supply hole S1 ejects the working fluid toward a clearance formed between the accumulator chamber R1 and a corresponding cylinder (that is, the high-temperature side cylinder 22) of the cylinders 22 and 32. The air supply hole S2 ejects the working fluid toward a clearance formed between the accumulator chamber R2 and a corresponding cylinder (that is, the low-temperature side cylinder 32) of the cylinders 22 and 32. The air supply holes S1 and S2 respectively corresponds to air supply portions.

Also, the stirling engine 10A is further provided with an introduction pipe 70A introducing a working fluid existing within the low-temperature working space into at least an inside of the expansion piston 21 of the expansion piston 21 and the compression piston 31, the low-temperature working space being included in the working space where the working fluid circulates between the cylinders 20 and 30 and having a temperature lower than a working space within the high-temperature side cylinder 22 (that is, the expansion space) in a driving state.

In this regard, specifically, the introduction pipe 70A introduces the working fluid existing within the low-temperature working space to the insides of the pistons 21 and 31. The introduction pipe 70A provided in such a way communicates the low-temperature working space with the accumulator chamber R1 provided in the expansion piston 21, and also communicates the low-temperature working space with the accumulator chamber R2 provided in the compression piston 31.

Preferably, the working space is a part having the lowest temperature, in the driving state, in the working space where the working fluid circulates between the cylinders 20 and 30. In this regard, specifically, the low-temperature working space is the working space (that is, the compression space) defined by the low-temperature side cylinder 32. In the stirling engine 10A, further specifically, an end, near the low-temperature working space, of the introduction pipe 70A is connected to an end, near the cooler 45, of the low-temperature side cylinder 32. Therefore, the introduction pipe 70A communicates the accumulator chambers R1 and R2 with a part on the cooler 45 side, to which the working fluid immediately after being cooled by the cooler 45, in the working space formed in the low-temperature side cylinder 32. Additionally, for example, the low-temperature working space may be a working space formed in the cooler 45 and a working space formed in the low-temperature side cylinder 32 and the cooler 45.

Figure 3:
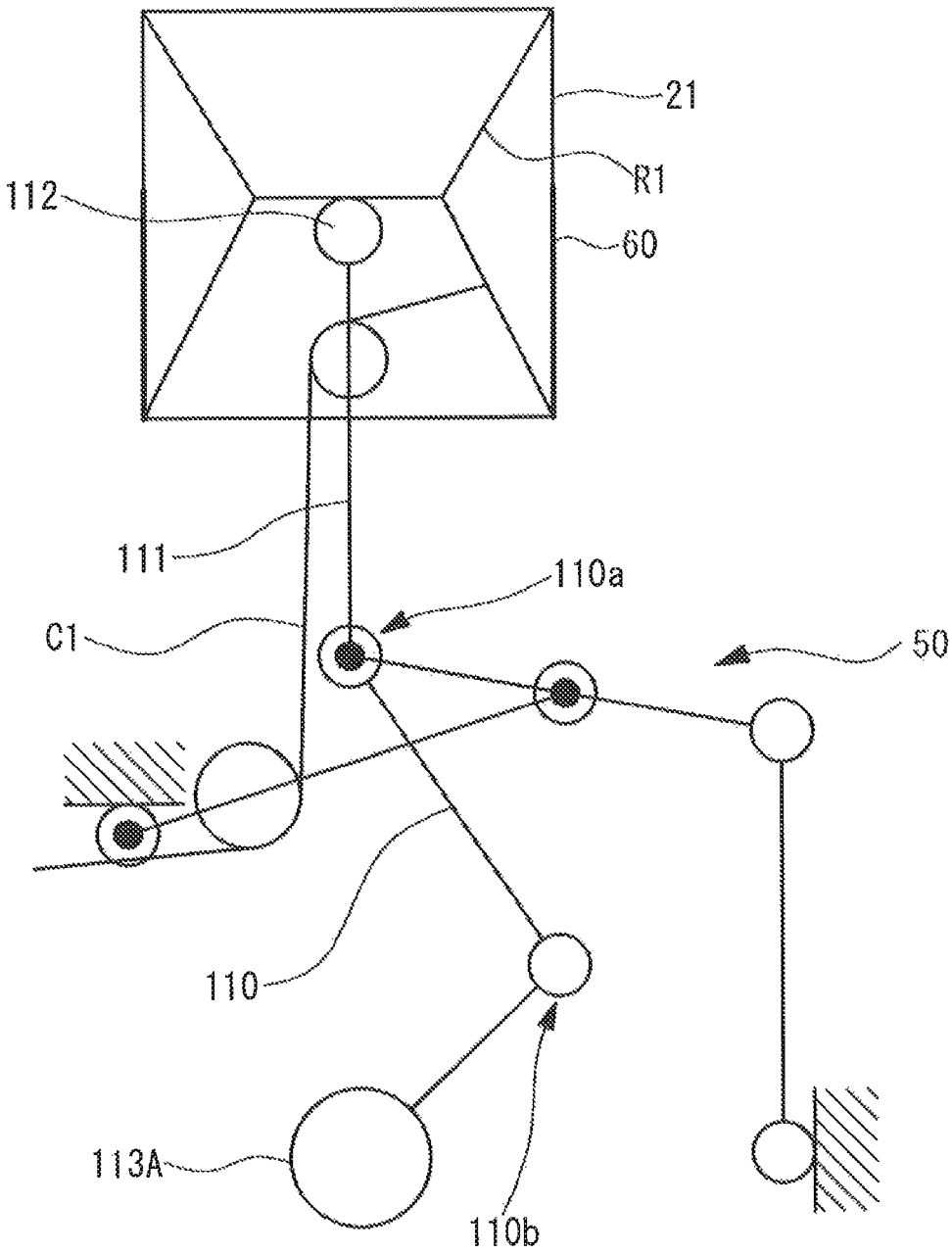
FIG. 3 is a view of a movable portion of an introduction pipe, in a high-temperature-side cylinder as an example, provided with the stirling engine gas lubrication structure according to the first embodiment.

The introduction pipe 70A connects the accumulator chambers R1 and R2 in such a manner as to be routed from the approximate linear linkage side. In order to connect the introduction pipe 70A with the accumulator chambers R1 and R2, the introduction pipe 70A is provided with a movable portion C1 capable of absorbing a positional change of the piston provided with the accumulator chamber (for example, the expansion piston 21 provided with the accumulator chamber R1) by its reciprocation movement. In this regard, in the stirling engine 10A, the movable portion C1 is applied to a resin tube which has a length such that the resin tube has a small or no tensile force when the piston, of the pistons 21 and 31, provided with accumulator chamber is located in the top dead center point. The resin tube is made of, for example, silicon. The movable portion C1 made of a resin tube gradually becomes looser, as the piston, of the pistons 21 and 31, provided with accumulator chamber more moves from the top dead center point to the bottom dead center point. As illustrated in FIG. 3, the movable portion C1 is provided so as not to interfere with the approximate linear linkage when becoming loose.

Returning to FIG. 1, a check valve 81 is provided in the introduction pipe 70A. The first check valve 81 allows the working fluid to flow from the low-temperature working space, and prohibits the working fluid from flowing to the low-temperature working space. In this regard, specifically, the first check valve 81 is provided between the end near the low-temperature working space and a portion of the introduction pipe 70A branched off toward the accumulator chambers R1 and R2.

The first check valve 81 provided in such a way is capable of maintaining a pressurized state of the working fluid introduced into the expansion piston 21 (specifically, the accumulator chamber R1), and maintaining a pressurized state of the working fluid introduced into the compression piston 31 (specifically, the accumulator chamber R2). And, the first check valve 81 is a pressurized fluid maintenance portion which maintains the pressurized state of the working fluid introduced by the introduction pipe 70A.

Additionally, in a case where the working fluid introduced by the introduction pipe 70A is maintained in the pressurized state, since each of the clearance between the piston 21 and the cylinder 22 and the clearance between the piston 31 and the cylinder 32 is several tens micrometers, it is difficult to eject the working fluid from the air supply holes S1 and S2 unless the internal pressures in the accumulator chambers R1 and R2 are high to some extent.

The introduction pipe 70A corresponds to a flow structure for the working fluid. In order to perform the static pressure gas lubrication in the stirling engine 10A, the stirling engine gas lubrication structure including the introduction pipe 70A and the first check valve 81 is achieved.

Next, a description will be given of effects of the stirling engine gas lubrication structure according to the present embodiment. In a case where this gas lubrication structure performs the static pressure gas lubrication, the introduction pipe 70A introduces the working fluid from the low-temperature working space into the expansion piston 21 (specifically, the accumulator chamber R1). Thus, this gas lubrication structure can prevent the promotion of the heat deformation of the expansion piston 21, as compared with a case where the working fluid is introduced from the expansion space into which the working fluid receiving heat in the heater 47 flows. Therefore, this gas lubrication structure can prevent or suppress the influence on the gas lubrication.

Thus, the autonomous static pressure gas lubrication can be suitably achieved. This gas lubrication structure can prevent or suppress the influence on the layer 60 by the static pressure gas lubrication in the high-temperature-side cylinder 20 side. Also, the autonomous static pressure gas lubrication can be suitably achieved.

Also, in this gas lubrication structure, the compression space is used as the low-temperature working space. In this regard, since the working fluid cooled in the cooler 45 flows into the compression space, the temperature of the working fluid is low. Therefore, this gas lubrication structure can suitably prevent or suppress the heat influence, and suppress heat loss occurring in a case where the working fluid immediately after receiving heat in the heater 47 is used for the static pressure gas lubrication. Thus, the autonomous static pressure gas lubrication can be suitably achieved. Further, in this gas lubrication structure, the end, near the low-temperature working space, of the introduction pipe 70A is connected to the end, near the cooler 45, of the low-temperature side cylinder 32. Therefore, the working fluid having a lower temperature can be introduced in performing the static pressure gas lubrication. Thus, the autonomous static pressure gas lubrication can be more suitably achieved.

Moreover, in this gas lubrication structure, the working fluid is introduced from the low-temperature working space into the expansion piston 21 (specifically, the accumulator chamber R1), and then the temperature of the working fluid is increased from when the working fluid is introduced to the expansion piston 21 to when the working fluid is ejected. As a result, the capacity of the working fluid at the time of the ejection is larger than that at the time of the introduction. Thus, this gas lubrication structure can perform the static pressure gas lubrication at the high-temperature-side cylinder 20 side by a use of a small amount of the working fluid. Therefore, in this gas lubrication structure, the amount of the working fluid is ensured with ease, and the part of the working fluid is introduced from the working space to suppress a reduction in the output of the stirling engine 1.0A. Thus, the autonomous static pressure gas lubrication can be suitably achieved.

Moreover, in this gas lubrication structure, the introduction pipe 70A introduces the working fluid from the low-temperature working space into the compression piston 31 (specifically, the accumulator chamber R2). Therefore, in this gas lubrication structure performing the static pressure gas lubrication in the low-temperature-side cylinder 30 side, the first check valve 81 maintaining the pressurized fluid can be commonly used in the cylinders 20 and 30. This simplifies this structure, and the autonomous static pressure gas lubrication can be suitably achieved.

Also, in order to provide the introduction pipe 70A for the accumulator chambers R1 and R2 communicated with each other, this gas lubrication structure is provided with the movable portions C1 made of the resin tube having a sufficient length with respect to the reciprocation of the pistons 21 and 31. Therefore, this gas lubrication structure introduces the working fluid from the low-temperature working space into the pistons 21 and 31. Also, the autonomous static pressure gas lubrication can be suitably achieved.

Second Embodiment

Figure 4:
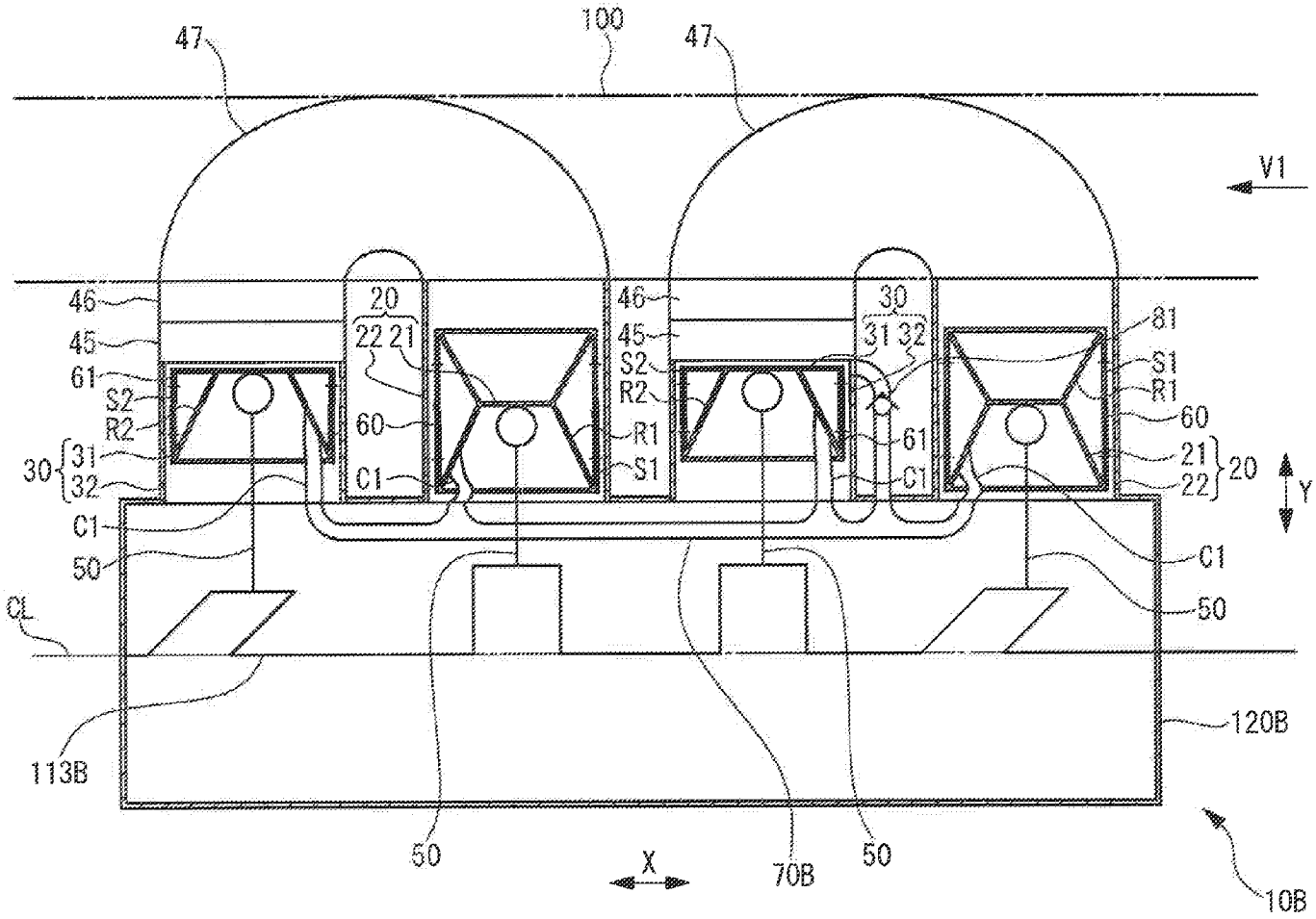
FIG. 4 is a schematic view of a stifling engine provided with a stirling engine gas lubrication structure according to a second embodiment.

FIG. 4 is a schematic view of a stirling engine 10B provided with a stirling engine gas lubrication structure according to a present embodiment. The stirling engine 10B is substantially the same as the stirling engine 10A, except that the stirling engine 10B is a multiple cylinder stirling engine, having four cylinders, including plural pairs (here, two) of the cylinders of the high-temperature-side cylinder 20 and the low-temperature-side cylinder 30, in response to this, a crank shaft 113B is provided instead of the crank shaft 113A, a crank case 120B is provided instead of the crank case 120A, and an introduction pipe 70B is provided instead of the introduction pipe 70A.

The crank shaft 113B and the crank case 120B are substantially the same as the crank shaft 113A and the crank case 120A respectively, except that the crank shaft 113B and the crank case 120B are suitable to the multiple cylinder stirling engine having four cylinders. In this regard, specifically, the crank shaft 113B converts the reciprocation movements of the pistons 21 and 31 of the plural pairs of the cylinders 20 and 30 into the rotational movement. Also, specifically, in the crank case 12013, the plural pairs of the cylinders 20 and 30 are linearly and parallel arranged with each other.

In a case where the stirling engine 10B performs the static pressure gas lubrication, the introduction pipe 70B introduces the working gas existing in any one of the low-temperature working spaces of the plural pairs of the cylinders into at least the inside of the expansion piston 21 of the pistons 21 and 31 of the plural pairs of the cylinders, but does not introduce the working gas existing in the low-temperature working spaces of the plural pairs of the cylinders.

In this regard, specifically, the introduction pipe 70B introduces the working fluid in the above mentioned low-temperature working space into the insides of the pistons 21 and 31 of the plural pairs of the cylinders.

The introduction pipe 70B provided in such a way communicates the above mentioned low-temperature working space with the accumulator chambers R1 of the expansion pistons 21 of the plural pairs of the cylinders, and communicates the above mentioned low-temperature working space with the accumulator chambers R2 of the compression pistons 31 of the plural pairs of the cylinders.

Like the first embodiment, the low-temperature working space is the expansion space. Likewise, in the stirling engine 10B, in order to the working fluid from the above mentioned low-temperature working space, an end, near the low-temperature working space, of the introduction pipe 70B is connected to an end, near the cooler 45, of the low-temperature side cylinder 32. In the stirling engine 10B, specifically, the above mentioned low-temperature working space is a low-temperature working space of the pair of the cylinders, arranged on the upstream side in the exhaust flowing direction V1, of the plural pairs of the cylinders. However, this configuration is not limited. For example, the low-temperature working space with which the introduction pipe 70B is communicated may be a low-temperature working space of the pair of the cylinders, arranged on the downstream side in the exhaust flowing direction V1, of the plural pairs of the cylinders. In this case, for example, the low-temperature working space with which the introduction pipe 70B is communicated is the low-temperature working space having the lowest temperature in the low-temperature working spaces of the plural pairs of the cylinders.

In order to connect the introduction pipe 70B to the accumulator chambers R1 and R2, the introduction pipe 70B is provided with the movable portion C1, like the first embodiment.

Also, the introduction pipe 70B is provided with the first check valve 81, like the first embodiment. The first check valve 81 is provided between the end, near the low-temperature working space, and the portion branched off of the introduction pipe 70B.

The first check valve 81 provided in such a way is capable of maintaining pressurized states of the working fluids introduced into the insides of the expansion pistons 21 (specifically, the accumulator chambers R1), and maintaining pressurized states of the working fluids introduced into the compression pistons 31 (specifically, the accumulator chambers R2).

The introduction pipe 70B corresponds to the flow structure for the working fluid. In order to perform the static pressure gas lubrication in the stirling engine 10B, the stirling engine gas lubrication structure including the introduction pipe 70B and the first check valve 81 is achieved.

Next, a description will be given of effects of the stirling engine gas lubrication structure according to the present embodiment. Since this gas lubrication structure is provided with the introduction pipe 70B, the gas lubrication structure has effects the same as the first embodiment.

On the other hand, in the gas lubrication structure, the introduction pipe 70B introduces the working gas existing in any one of the low-temperature working spaces of the plural pairs of the cylinders into at least the inside of the expansion piston 21 of the pistons 21 and 31 of the plural pairs of the cylinders. Thus, in this gas lubrication structure, the single introduction pipe 70B introduces the working fluid from the low-temperature working space. This reduces the number of the parts and simplifies the structure, as compared with a case where the introduction pipe 70A is provided for every pair of the cylinders. Thus, the autonomous static pressure gas lubrication can be suitably achieved. Also, in this gas lubrication structure, the first check valve 81 maintaining the pressurized fluids can be commonly used in all the cylinders 20 and 30. This reduces the number of the parts and simplifies the structure. Thus, the autonomous static pressure gas lubrication can be suitably achieved.

Further, the low-temperature working space with which the introduction pipe 70B is communicated can be the low-temperature working space having a temperature lowest in the low-temperature working spaces of the plural pairs of the cylinders. Therefore, this gas lubrication structure can suitably prevent or suppress the heat influence, and can suitably suppress heat loss. Thus, the autonomous static pressure gas lubrication can be suitably achieved.

Third Embodiment

Figure 5:
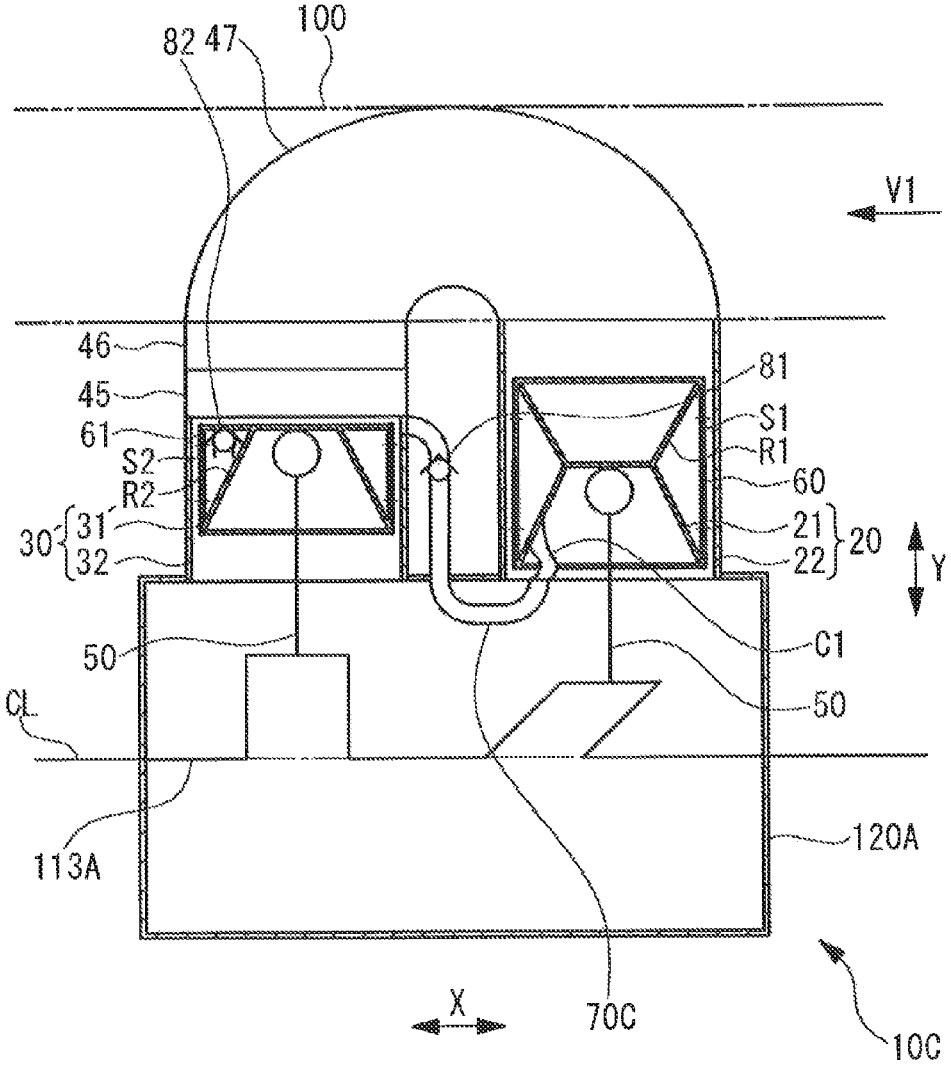
FIG. 5 is a schematic view of a stirling engine provided with a stirling engine gas lubrication structure according to a third embodiment.

FIG. 5 is a schematic view of a stirling engine 10C provided with a stirling engine gas lubrication structure according to a present embodiment. The stirling engine 10C is substantially the same as the stirling engine 10A, except that the stirling engine 10C is provided with an introduction pipe 70C and a low-temperature-side cylinder 30 instead of the introduction pipe 70A and the low-temperature-side cylinder 30. In this regard, the low-temperature-side cylinder 30' is substantially the same as the low-temperature-side cylinder 30, except that the low-temperature-side cylinder 30' is provided with a compression piston 31' instead of the compression piston 31. Also, the compression piston 31' is substantially the same as the compression piston 31, except a way to introduce the working fluid into the compression piston 31' is different form the way to introduce the working fluid into the compression piston 31. Additionally, the same variation is applicable to the stirling engine 10B according to the second embodiment as mentioned above.

In order to perform the static pressure gas lubrication at the low-temperature-side cylinder 30 side, a check valve 82 is provided in the compression piston 31'. The second check valve 82 is provided at the upper side and the inside of the compression piston 31' (specifically, the accumulator chamber R2). The second check valve 82 allows the working fluid to flow from the compression space, and prohibits the working fluid from flowing to the compression space. In order to perform the static pressure gas lubrication at the low-temperature-side cylinder 30' side, the second cheek valve 82 provided in such a way is capable of directly introducing the working fluid from the compression space into the compression piston 31' (specifically, the accumulator chamber R2), and maintaining a pressurized state of the working fluid introduced into the compression piston 31'.

On the other hand, the introduction pipe 70C is substantially the same as the introduction pipe 70A, except that the introduction pipe 70A introduces the working fluid into the expansion piston 21. Specifically, the introduction pipe 70C provided in such a way communicates the low-temperature working space with the accumulator chamber R1 of the expansion piston 21. Thus, in the stirling engine 10C, the first check valve 81 maintains the pressurized state of the working fluid introduced into the expansion piston 21 (specifically, the accumulator chamber R1) of the pistons 21 and 31'.

The introduction pipe 70C corresponds to a flow structure for the working fluid. In order to perform the static pressure gas lubrication in the stirling engine 10C, the stirling engine gas lubrication structure including the introduction pipe 70C and the first check valve 81 is achieved.

Next, a description will be given of effects of the stirling engine gas lubrication structure according to the present embodiment. In this gas lubrication structure, the introduction pipe 70C introduces the working fluid existing in the low-temperature working space into only the inside of the expansion piston 21 (specifically, the accumulator chamber R1) of the pistons 21 and 31'. For this reason, the cylinders 20 and 30' cannot commonly use the first check valve 81 in this gas lubrication structure. However, in other aspects, the introduction pipe 70C is provided so that the effects the same as the gas lubrication, structure according to the first embodiment. On the other hand, this gas lubrication structure is provided with the introduction pipe 70C, thereby eliminating the movable portion C1, selected from the movable portions C1 provided in the introduction pipe 70A according to the first embodiment, corresponding to the compression piston 31. In this regard, a concern may remain as to whether or not the movable portion. C1 made of the resin tube has a reasonable reliability in consideration of durability when the movable portion C1 is used for a long term. Therefore, a reduction in the number of the movable portions C1 that is the concern about the reliability causes this gas lubrication structure to have a high reliability. Thus, the autonomous static pressure gas lubrication can be suitably achieved.

Fourth Embodiment

Figure 6:
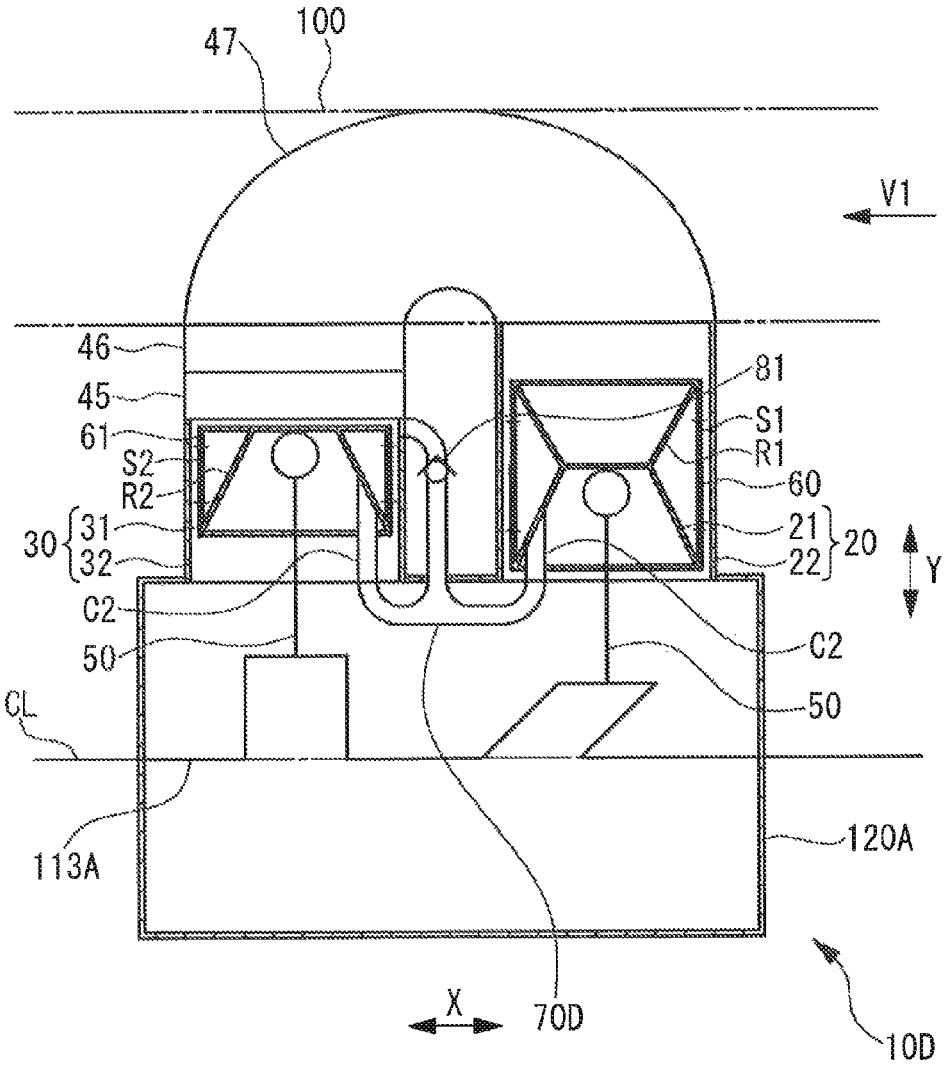
FIG. 6 is a schematic view of a stirling engine provided with a stirling engine gas lubrication structure according to a fourth embodiment.

FIG. 6 is a schematic view of a stirling engine 10D provided with a stirling engine gas lubrication structure according to a present embodiment. The stirling engine 10D is substantially the same as the stirling engine 10A, except that the stirling engine 101D is provided with an introduction pipe 70D instead of the introduction pipe 70A. Also, the introduction pipe 70D is substantially the same as the introduction pipe 70A, except that the introduction pipe 70D is provided with movable portions C2 instead of the movable portions C1. Additionally, the same variation is applicable to the stirling engines 10B and 10C according to the second embodiment as mentioned above.

Figure 7:
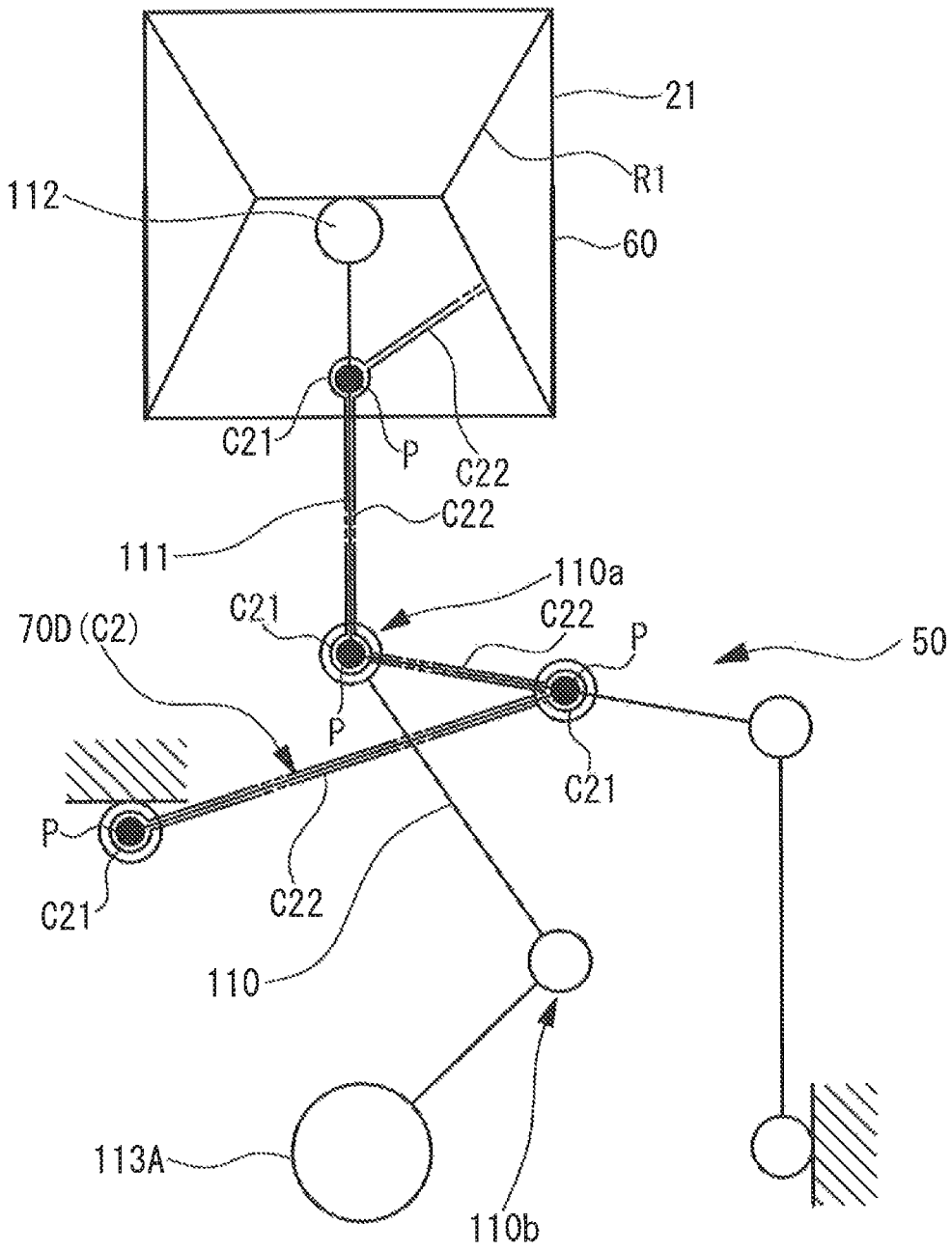
FIG. 7 is a view of a movable portion of an introduction pipe, in a high-temperature-side cylinder as an example, provided with the stirling engine gas lubrication structure according to the fourth embodiment.

In the stirling engine 10D, in order to connect the introduction pipe 70D with the accumulator chambers R1 and R2, the introduction pipe 70D is provided along the approximate linear linkage corresponding to a piston, of the pistons 21 and 31, (the expansion piston 21 in the example illustrated in FIG. 7) provided with an accumulator chamber (the accumulator chamber R1 in the example illustrated in FIG. 7) connected to the introduction pipe 701D.

In the stifling engine 10D, a part, of the introduction pipe 701D, provided along the corresponding approximate linear linkage includes: a joint portion C21 capable of rotating in response to a movement of the corresponding approximate linear linkage; and pipe portions C22 connected to each other through the joint portion C21. The rotational center of the joint portion C21 is identical to a fulcrum of the corresponding approximate linear linkage. Thus, the movable portion C2 having such a configuration can follow the movement of the approximate linear linkage.

Figure 8:
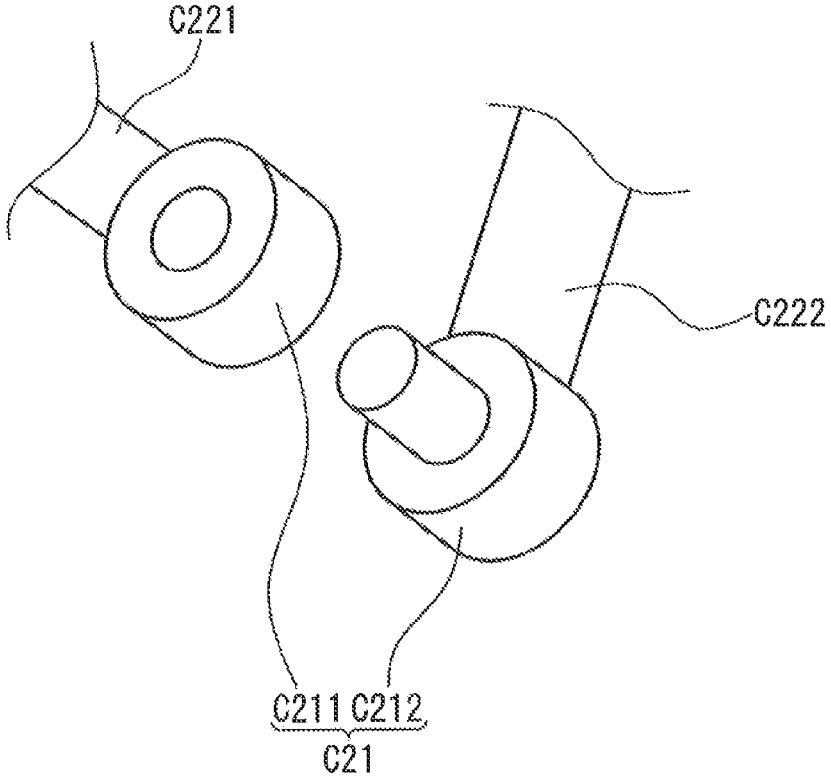
FIG. 8 is an exemplary view of a joint portion.

Specifically, in the joint portion C21 as illustrated in FIG. 8, for example, a ring-shaped connecting portion C211 is provided at an end of a pipe portion C221 of the two pipe portions C22 connected to each other through the joint portion C21, and a column-shaped connecting portion C212 fitted into the ring-shaped connecting portion C211 is provided at an end of the other pipe portion C222. The ring-shaped connecting portion C211 is rotatably attached with the column-shaped connecting portion C212. In this case, the flow passages provided within two pipe portions C221 and 0222 are connected to each other, in the joint portion C21, through an opening (for example, a ring-shaped opening) provided at an inner circumferential surface of the ring-shaped connecting portion C211 and through an opening (for example, a circle-shaped opening) provided at an outer circumferential surface of the column-shaped connecting portion C212. Additionally, the connecting portion C211 and the pipe portion C221 may be integrally or formed, or separately formed from each other. This is also applicable to the connecting portion C212 and the pipe portion C222.

The introduction pipe 70D corresponds to the flow structure for the working fluid. In order to perform the static pressure gas lubrication in the stirling engine 10D, the stirling engine gas lubrication structure including the introduction pipe 70D and the first check valve 81 is achieved.

Next, a description will be given of effects of the stirling engine gas lubrication structure according to the present embodiment. In this gas lubrication structure, in order to connect the introduction pipe 70D with the accumulator chambers R1 and R2, the introduction pipe 70D is provided with the movable portions C2 following the movement of the approximate linear linkage. Therefore, this gas lubrication linkage can be made from metal having a durability greater than that of resin. This increases a reliability. Thus, the autonomous static pressure gas lubrication can be suitably achieved.

Fifth Embodiment

Figure 9:
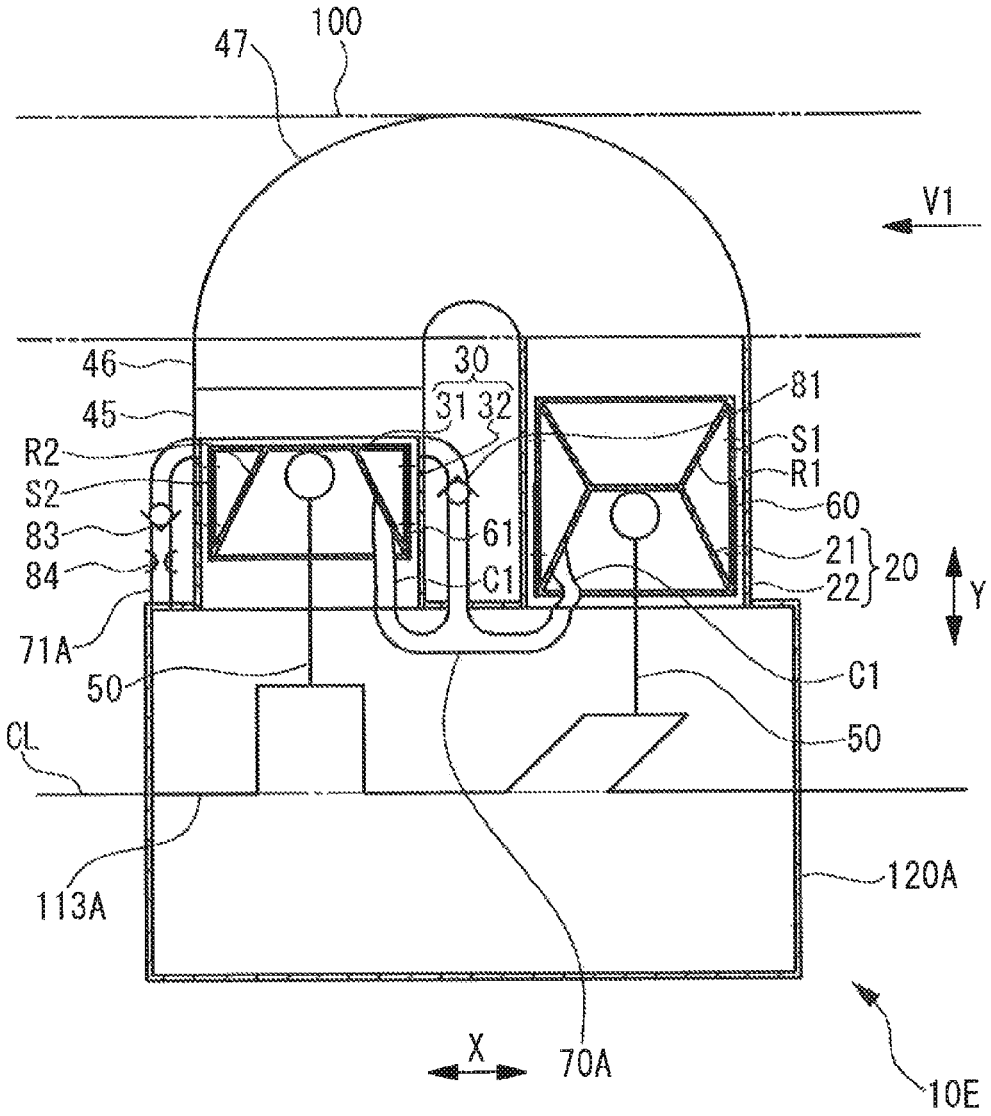
FIG. 9 is a schematic view of a stirling engine provided with a stifling engine gas lubrication structure according to a fifth embodiment.

FIG. 9 is a schematic view of a stifling engine 10E provided with a stirling engine gas lubrication structure according to a present embodiment. The stirling engine 10E is substantially the same as the stirling engine 10A, except that the stirling engine 10E is provided with a communication pipe 71A, a third check valve 83, and a reduction valve 84. Additionally, the same variation is applicable to the stirling engines 10B, 10C, and 10D according to the second, third, fourth embodiments as mentioned above, respectively.

The communication pipe 71A communicates the inner space of the crank case 120 with the working space where the working fluid circulates between the high-temperature-side cylinder 20 and the low-temperature-side cylinder 30 in the pair of the cylinders connecting with the introduction pipe 70A. The communication pipe 71A corresponds to a communication portion.

In this regard, specifically, the communication pipe 71A communicates the inner space of the crank case 120A with the low-temperature working space communicating with the introduction pipe 70A. Thus, specifically, the communication pipe 71A communicates the inner space of the crank case 120A with the expansion space. Thus, the communication pipe 71A provided in such a way has an end, near the low-temperature working space, connecting to the end, near the cooler 45, of the low-temperature side cylinder 32.

The third check valve 83 is provided in the communication pipe 71A, allows the working fluid from the inner space of the crank case 120A, and prohibits the working fluid from flowing toward the inner space of the crank case 120A.

The third check valve 83 provided in such a way is a supplement portion which prohibits the working fluid from flowing toward the inner space of the crank case 120A, and which is capable of supplementing the working fluid from the crank case 120A to the working space with which the communication pipe 71A is communicated when the pressure in the working space communicating with the communication pipe 71A is lower than the pressure in the inner space of the crank case 120A.

The reduction valve 84 is provided between the third check valve 83 and the crank case 120A in the communication pipe 71A, and is a flow amount adjustment portion adjusting the flow amount of the working fluid flowing through the communication pipe 71A. In this regard, a reduction degree of the reduction valve 84 is beforehand set to ensure an appropriate amount of the working fluid supplemented from the crank case 120A to the working space with which the communication pipe 71A is communicated.

In order to perform the static pressure gas lubrication in the stifling engine 10E, the stirling engine gas lubrication structure including the introduction pipe 70A, the communication pipe 71A, the first check valve 81, the third check valve 83, and the reduction valve 84 is achieved.

Next, a description will be given of effects of the stirling engine gas lubrication structure according to the present embodiment. In this gas lubrication structure, the communication pipe 71A communicates the inner space of the crank case 120A with the working space of the pair of the cylinders defining the low-temperature working space with which the communication pipe 71A is communicated with. Thus, in this gas lubrication structure, even when the pressure in the working space is decreased by the static pressure gas lubrication where the working fluid is introduced through the introduction pipe 70A, the working fluid is supplemented from the inner space of the crank case 120A to the working space through the communication pipe 71A in response to the pressure difference. This can prevent or suppress a reduction in the pressure. Thus, this gas lubrication structure can prevent or suppress a reduction in the output of the stirling engine 10E in accordance with the static pressure gas lubrication where the working fluid is introduced through the introduction pipe 70A. Thus, the autonomous static pressure gas lubrication can be suitably achieved.

Also, in this gas lubrication structure, the communication pipe 71A communicates the inner space of the crank case 120A with the low-temperature working space with which the introduction pipe 70A is communicated, thereby supplementing the working fluid with "high responsibility. Thus, the autonomous static pressure gas lubrication can be suitably achieved.

Further, in this gas lubrication structure, the third check valve 83 is provided in the communication pipe 71A, thereby maintaining the pressure in the working space with a simple structure and supplementing the working fluid. Thus, the autonomous static pressure gas lubrication can be suitably achieved. Furthermore, in this gas lubrication structure, the reduction valve $4 is provided in the communication pipe 71A, for example, thereby preventing or suppressing an amount of the working fluid more than necessary from being supplemented from the inner space of the crank case 120A to the working space in response to the pressure difference. This ensures an appropriate supplement amount of the working fluid in light of the desired output of the stirling engine 10E. Thus, the autonomous static pressure gas lubrication can be suitably achieved.

Sixth Embodiment

Figure 10:
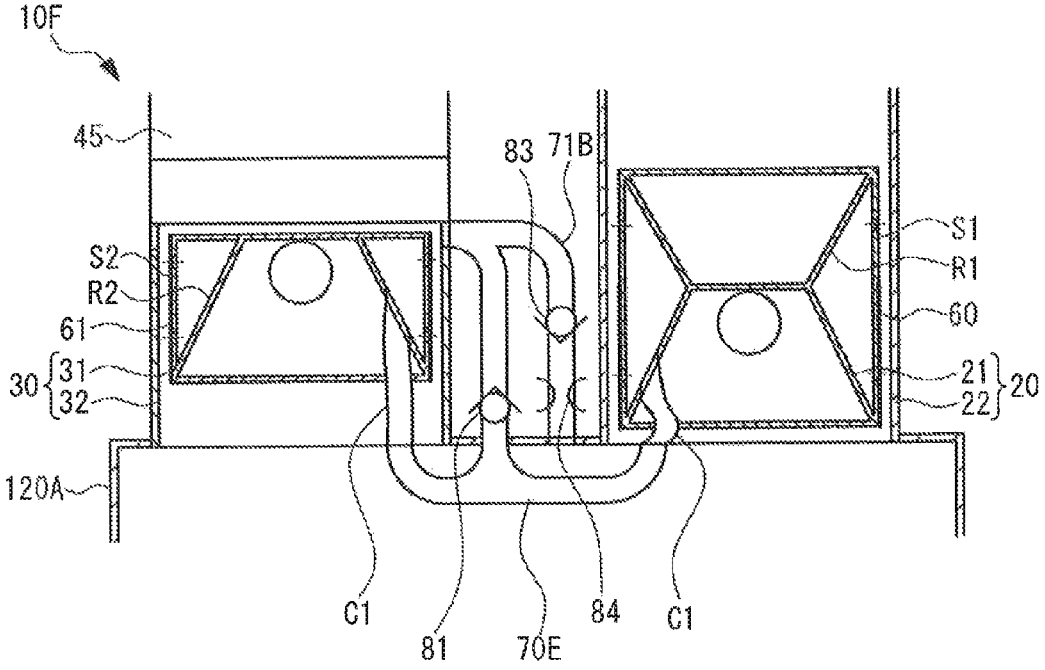
FIG. 10 is a schematic view of a main portion of a stirling engine provided with a stirling engine gas lubrication structure according to a sixth embodiment.

FIG. 10 is a schematic view of a stirling engine 10F provided with a stirling engine gas lubrication structure according to a present embodiment. The stirling engine 10F is substantially the same as the stirling engine 10E, except that the stirling engine 10F is provided with a communication pipe 71B and an introduction pipe 70E instead of the communication pipe 71A and the introduction pipe 70A, respectively. Additionally, the same variation is applicable to the stifling engines 10B, 10C, and 10D according to the fifth embodiment as mentioned above.

The introduction pipe 70E and the communication pipe 71B are substantially the same as the introduction pipe 70A and communication pipe 71A, respectively, except that a part of the flow passage through which the working fluid flows is commonly used. In this regard, specifically, an end, near the low-temperature working space, of the introduction pipe 70E and the communication pipe 71B is commonly used. In order to perform the static pressure gas lubrication in the stirling engine 10F, the stirling engine gas lubrication structure including the introduction pipe 70E, the communication pipe 71B, the first check valve 81, the third check valve 83, and the reduction valve 84 is achieved.

Next, a description will be given of effects of the stirling engine gas lubrication structure according to the present embodiment. In this gas lubrication structure, the part of the flow passage through which the working fluid flows between the introduction pipe 70E and the communication pipe 71B is commonly used, thereby reducing the cost based on a reduction in the number of the parts, and reducing the size of the stirling engine 10F. Thus, the autonomous static pressure gas lubrication can be suitably achieved, as compared with the stirling engine 10E.

In this gas lubrication structure, the end, near the low-temperature working space, of the introduction pipe 70E and the communication pipe 71B is commonly used. Thus, in a case where the low-temperature side cylinder 32 is provided with connecting openings for the introduction pipe 70E and the communication pipe 71B, a connecting opening is commonly used for the introduction pipe 70E and the communication pipe 71B. Therefore, in this gas lubrication structure in a case where the low-temperature side cylinder 32 is provided with connecting openings for the introduction pipe 70E and the communication pipe 71B, the connecting opening is commonly used, thereby facilitating manufacture of the low-temperature side cylinder 32 and reducing the cost. Thus, the autonomous static pressure gas lubrication can be suitably achieved.

While the exemplary embodiments of the present invention have been illustrated in detail, the present invention is not limited to the above-mentioned embodiments, and other embodiments, variations and modifications may be made without departing from the scope of the present invention.

For example, in the above mentioned each embodiment, the static pressure gas lubrication is also performed at the low-temperature-side cylinder 30 side. However, the present invention is not limited to this. For example, dynamic pressure gas lubrication may be performed at the low-temperature-side cylinder side. Also, for example, another static pressure gas lubrication other than the static pressure gas lubrication described in each embodiment may be performed appropriately.

DESCRIPTION OF LETTERS OR NUMERALS

10A, 10B, 10C, 10D, 10E, 10F stifling engine
20 high-temperature cylinder
21 expansion piston.
22 high-temperature cylinder
30, 30' low-temperature cylinder
31, 31' compression piston

32 low-temperature-cylinder
50 grasshopper mechanism
70A, 70B, 70C, 70D, 70E introduction pipe
71A, 71B communication pipe
81 first check valve
82 second check valve
83 third check valve
84 reduction valve

The invention claimed is:

1. A stirling engine gas lubrication structure comprising a pair of cylinders comprising:

a high-temperature side cylinder and a high-temperature side piston reciprocating within the high-temperature side cylinder; and a low-temperature side cylinder and a low-temperature side piston reciprocating within the low-temperature side cylinder, at least the high-temperature side piston comprising:

a hollow portion; and an air supply portion ejecting a working fluid from the hollow portion toward a clearance between the high-temperature side piston and the high-temperature side cylinder, further comprising a flow structure introducing a working fluid existing within a low-temperature working space into at least the hollow portion, the low-temperature working space being included in a working space where the working fluid circulates between the high-temperature side cylinder and the low-temperature side cylinder, a temperature of the working fluid in the low-temperature working space lower than that of the working fluid in a working space of the high-temperature side cylinder in a driving state, the flow structure comprising:

an introduction pipe connected to the low-temperature side cylinder; and a resin tube connected between the introduction pipe and the hollow portion.

2. A stirling engine gas lubrication structure comprising a pair of cylinders comprising:

a high-temperature side cylinder and a high-temperature side piston reciprocating within the high-temperature side cylinder; and a low-temperature side cylinder and a low-temperature side piston reciprocating within the low-temperature side cylinder, at least the high-temperature side piston comprising:

a hollow portion; and an air supply portion ejecting a working fluid from the hollow portion toward a clearance between the high-temperature side piston and the high-temperature side cylinder, further comprising a flow structure, communicating a low-temperature working space with the hollow portion of the high-temperature side piston, the low-temperature working space being included in a working space where the working fluid circulates between the high-temperature side cylinder and the low-temperature side cylinder, a temperature of the working fluid in the low-temperature working space lower than that of the working fluid in a working space of the high-temperature side cylinder in a driving state, the flow structure comprising:

an introduction pipe connected to the low-temperature side cylinder; and a resin tube connected between the introduction pipe and the hollow portion.

3. The stirling engine gas lubrication structure of claim 2, wherein the stirling engine is a multiple cylinder stirling engine comprising at least four cylinders that are plural pairs of cylinders, and the flow structure communicates the low-temperature working space, having a temperature being the lowest in the low-temperature working spaces of the plural pairs of the cylinders, with the hollow portions of the high-temperature side pistons of the plural pairs of the cylinders.

4. The stirling engine gas lubrication structure of claim 2, wherein the stirling engine comprises an approximate linear linkage causing a corresponding piston of the high-temperature side piston and the low-temperature side piston of the pair of the cylinders to reciprocate linearly, the flow structure is provided along the approximate linear linkage corresponding to a piston, of the high-temperature side piston and the low-temperature side piston, comprising the hollow portion connected to the flow structure, a part of the flow structure is provided along the corresponding approximate linear linkage, and the part is a movable portion comprising: a joint portion capable of rotating in response to a movement of the corresponding approximate linear linkage; and pipe portions connected to each other through the joint portion, and a rotational center of the joint portion is identical to a fulcrum of the corresponding approximate linear linkage.

5. The stirling engine gas lubrication structure of claim 2, further comprising a communication portion communicating an inner space of a crank case provided in the stirling engine with a working space where the working fluid circulates between the high-temperature side cylinder and the low-temperature side cylinder in the pair of the cylinders defining the low-temperature working space communicating with the flow structure.

* * * * *